US010543888B2

(12) United States Patent
Garbarek

(10) Patent No.: US 10,543,888 B2
(45) Date of Patent: Jan. 28, 2020

(54) BUOY ASSEMBLY

(71) Applicant: Crystal Garbarek, Hartford, WI (US)

(72) Inventor: Crystal Garbarek, Hartford, WI (US)

( * ) Notice: Subject to any disclaimer, the term of this patent is extended or adjusted under 35 U.S.C. 154(b) by 0 days.

(21) Appl. No.: 15/994,639

(22) Filed: May 31, 2018

(65) Prior Publication Data

US 2019/0367134 A1 Dec. 5, 2019

(51) Int. Cl.
*B63B 22/04* (2006.01)
*A63B 31/12* (2006.01)

(52) U.S. Cl.
CPC ..... *B63B 22/04* (2013.01); *A63B 31/12* (2013.01)

(58) Field of Classification Search
CPC ..... B63B 22/04; A63B 31/12
USPC ..... 473/446, 424, 423, 506
See application file for complete search history.

(56) References Cited

U.S. PATENT DOCUMENTS

| | | | | |
|---|---|---|---|---|
| 2,830,309 A | | 4/1958 | Lawson | |
| 3,760,440 A | | 9/1973 | Casciano | |
| 3,804,409 A | * | 4/1974 | Schachner | A63B 69/0079 473/423 |
| 3,877,096 A | | 4/1975 | Scesney | |
| 4,598,661 A | | 7/1986 | Roe | |
| 5,067,920 A | | 11/1991 | Brisky | |
| 5,094,462 A | * | 3/1992 | Boyle | A63B 69/0086 473/576 |
| 5,443,576 A | * | 8/1995 | Hauter | A63B 69/0086 273/DIG. 19 |
| D426,585 S | * | 6/2000 | Manniso | D21/301 |
| 6,749,473 B1 | | 6/2004 | Lower | |
| 6,935,912 B1 | | 8/2005 | Myers | |
| D706,372 S | | 6/2014 | Day | |
| 9,371,118 B2 | | 6/2016 | King et al. | |
| 10,054,305 B1 | * | 8/2018 | Slepack | F21V 33/0064 |

* cited by examiner

*Primary Examiner* — John E Simms, Jr.
*Assistant Examiner* — Rayshun K Peng

(57) ABSTRACT

A buoy assembly for use in water activities includes a shell that defines an interior space. The interior space is substantially empty so that the shell is buoyant. A net is positioned around and coupled to the shell. Each of opposing ends of a line is coupled to the net. A fastener, which is slidably coupled to the line, defines a wrist loop that is positioned distal from the shell. The fastener is selectively fixedly couplable to the line so that the fastener is positioned to be selectively slid on the line toward a wrist of user that is positioned in the wrist loop. The fastener is positioned to fixedly couple to the line to couple the shell to the user.

1 Claim, 3 Drawing Sheets

BUOY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to buoy assemblies and more particularly pertains to a new buoy assembly for use in water activities.

BRIEF SUMMARY OF THE INVENTION

An embodiment of the disclosure meets the needs presented above by generally comprising a shell that defines an interior space. The interior space is substantially empty so that the shell is buoyant. A net is positioned around and coupled to the shell. Each of opposing ends of a line is coupled to the net. A fastener, which is slidably coupled to the line, defines a wrist loop that is positioned distal from the shell. The fastener is selectively fixedly couplable to the line so that the fastener is positioned to be selectively slid on the line toward a wrist of user that is positioned in the wrist loop. The fastener is positioned to fixedly couple to the line to couple the shell to the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
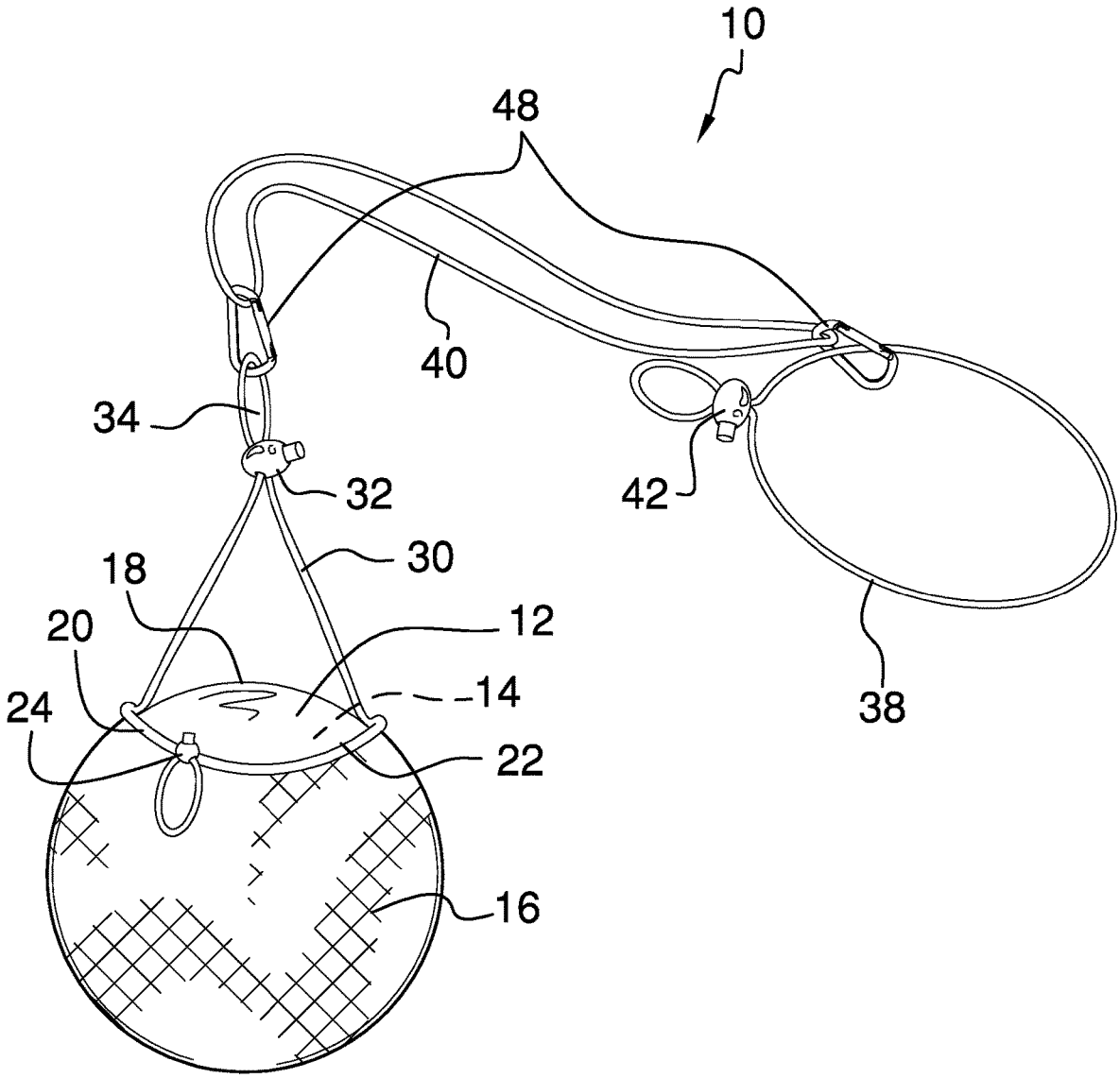
FIG. 1 is an isometric perspective view of a buoy assembly according to an embodiment of the disclosure.
Figure 2:
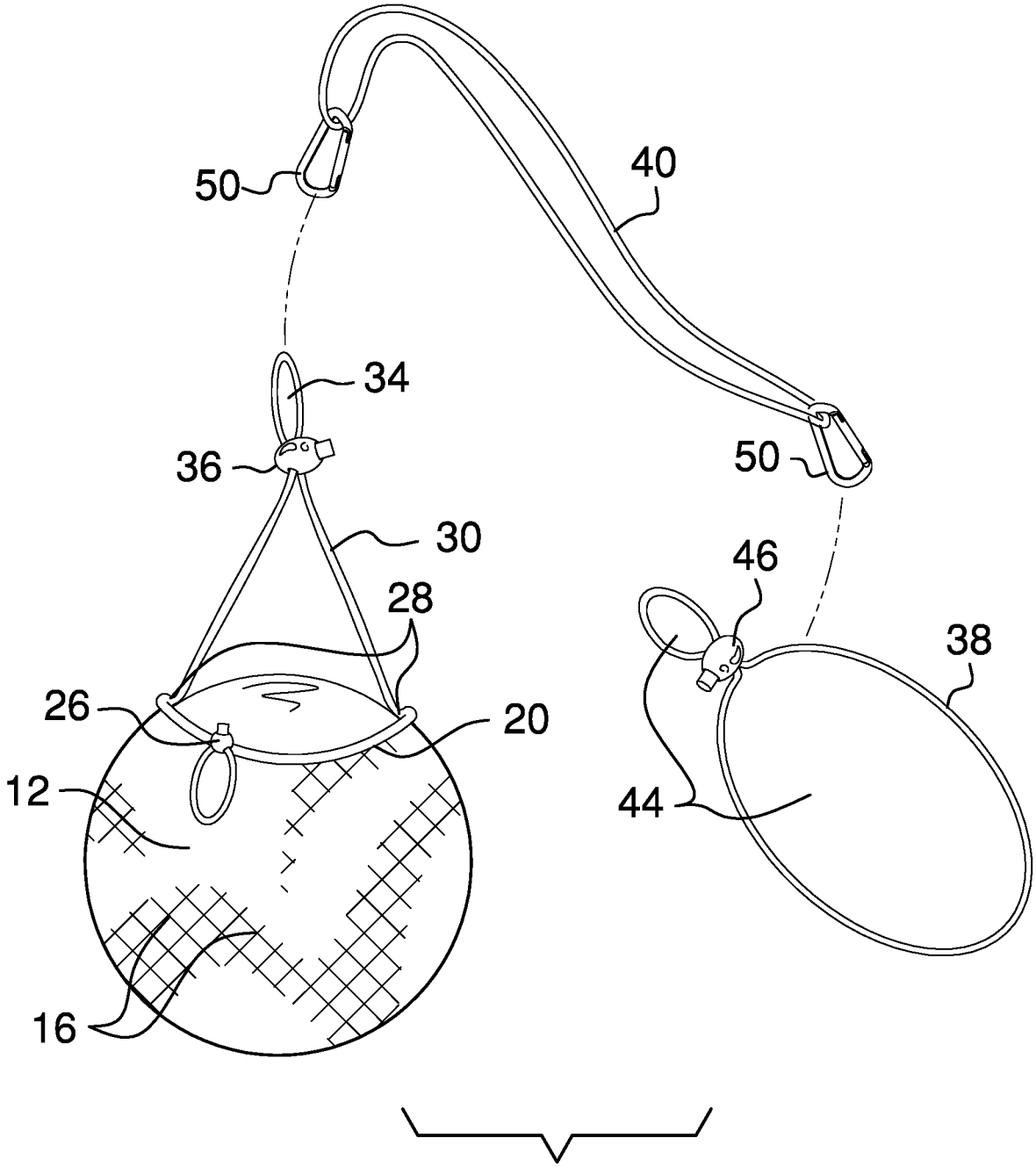
FIG. 2 is an exploded view of an embodiment of the disclosure.
Figure 3:
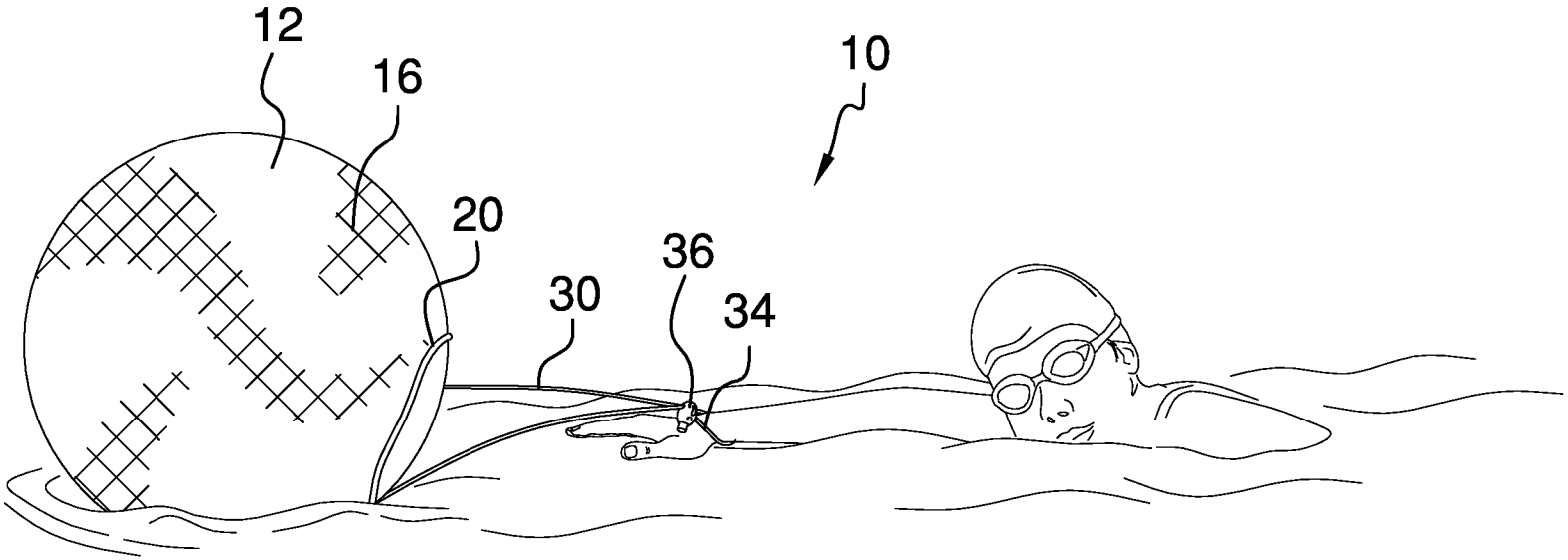
FIG. 3 is an in-use view of an embodiment of the disclosure.

With reference now to the drawings, and in particular to FIGS. 1 through 3 thereof, a new buoy assembly embodying the principles and concepts of an embodiment of the disclosure and generally designated by the reference numeral 10 will be described.

As best illustrated in FIGS. 1 through 3, the buoy assembly 10 generally comprises a shell 12 that defines an interior space 14. The interior space 14 is substantially empty so that the shell 12 is buoyant. A net 16 is positioned around and coupled to the shell 12. The net 16 comprises fish netting or the like. An opening 18 is positioned in the net 16. The opening 18 is positioned to selectively insert the shell 12 into the net 16. The opening 18 allows the shell 12 to be removed from the net 16 for maintenance.

A cord 20 is coupled to the net 16 and extends around a circumference 22 of the opening 18. The cord 20 comprises elastic or the like. A cord coupler 24 is slidably coupled to the cord 20. The cord coupler 24 comprises a cord lock 26. The cord coupler 24 is selectively fixedly couplable to the cord 20. The cord coupler 24 is positioned to slide on the cord 20 to decrease the circumference 22 of the opening 18. The cord coupler 24 is positioned to fixedly couple to the cord 20 to couple the net 16 to the shell 12, as shown in FIG. 2.

Each of opposing ends 28 of a line 30 is coupled to the net 16, as shown in FIG. 1. The line 30 comprises elastic or the like. The opposing ends 28 are coupled to the cord 20 so that the opposing ends 28 are substantially opposingly positioned on the circumference 22 of the opening 18.

A fastener 32 is slidably coupled to the line 30 and defines a wrist loop 34 that is positioned distal from the shell 12. The fastener 32 is selectively fixedly couplable to the line 30. The fastener 32 is positioned to be selectively slid on the line 30 toward a wrist of user that is positioned in the wrist loop 34. The fastener 32 is positioned to fixedly couple to the line 30 to couple the shell 12 to the user, as shown in FIG. 3. The fastener 32 comprises a cord fastener 36.

The assembly 10 also comprises a first rope 38 and a second rope 40, as shown in FIG. 2. The first rope 38 and the second rope 40 are circular. The first rope 38 is configured to loopedly position around a substrate, such as an ankle of the user and an element of a kayak, paddleboard or canoe. The first rope 38 and the second rope 40 comprise elastic or the like.

A rope coupler 42 is slidably coupled to the first rope 38 and defines a pair of tether loops 44, as shown in FIG. 2. The rope coupler 42 is selectively fixedly couplable to the first rope 38. One of the tether loops 44 is configured to position around the substrate. The rope coupler 42 is positioned to be slid on the first rope 38 toward the substrate, positioning the rope coupler 42 to fixedly couple to the first rope 38 to couple the first rope 38 to the substrate. The rope coupler 42 comprises a cord toggle 46.

Each of a pair of clips 48 is coupled to the second rope 40, as shown in FIG. 2. One of the clips 48 is positioned to selectively couple to the wrist loop 34. The other of the clips 48 is positioned to selectively couple to the first rope 38 to couple the shell 12 to the substrate. Each clip 48 comprises a carabiner 50 that is positioned around the second rope 40.

In use, the user is positioned to couple the shell 12 to the wrist of the user using the wrist loop 34 and the cord fastener 36, or to the ankle of the user using a respective tether loop 44 and the cord toggle 46. Alternatively, the user is positioned to couple the shell 12 to the substrate using the respective tether loop 44 and the cord toggle 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A buoy assembly comprising:

a shell defining an interior space, said interior space being substantially empty wherein said shell is buoyant;

a net positioned around said shell such that said net is coupled to said shell;

an opening positioned in said net wherein said opening is positioned for selectively inserting said shell into said net;

a cord coupled to said net, said cord extending around a circumference of said opening;

a cord coupler slidably coupled to said cord, said cord coupler being selectively fixedly couplable to said cord wherein said cord coupler is positioned for sliding on said cord for decreasing said circumference of said opening positioning said cord coupler for fixedly coupling to said cord for coupling said net to said shell, said cord coupler comprising a cord lock;

a line having opposing ends, each said opposing end being coupled to said net, said opposing ends being coupled to said cord such that said opposing ends are substantially opposingly positioned on said circumference of said opening;

a fastener slidably coupled to said line defining a wrist loop distal from said shell, said fastener being selectively fixedly couplable to said line wherein said fastener is positioned for selectively sliding on said line toward a wrist of user positioned in said wrist loop positioning said fastener for fixedly coupling to said line for coupling said shell to the user, said fastener comprising a cord fastener;

a first rope, said first rope being circular wherein said first rope is configured for loopedly positioning around a substrate;

a rope coupler slidably coupled to said first rope defining a pair of tether loops, said rope coupler being selectively fixedly couplable to said first rope wherein one of said tether loops is configured for positioning around the substrate positioning said rope coupler for sliding on said first rope toward the substrate, positioning said rope coupler for fixedly coupling to said first rope for coupling said first rope to the substrate, said rope coupler comprising a cord toggle;

a second rope, said second rope being circular; and a pair of clips coupled to said second rope wherein one of said clips is positioned for selectively coupling to said wrist loop and the other of said clips is positioned for selectively coupling to said first rope for coupling said shell to the substrate, each said clip comprising a carabiner positioned around said second rope.

* * * * *